US008910570B2

(12) United States Patent
Smith

(10) Patent No.: US 8,910,570 B2
(45) Date of Patent: Dec. 16, 2014

(54) APPARATUS AND METHOD FOR CALCULATING REGISTRATION ERROR OF A ROTARY DIE

(75) Inventor: Brandon Smith, Kansas City, MO (US)

(73) Assignee: Preco, Inc., Lenexa, KS (US)

( * ) Notice: Subject to any disclaimer, the term of this patent is extended or adjusted under 35 U.S.C. 154(b) by 594 days.

(21) Appl. No.: 12/945,389

(22) Filed: Nov. 12, 2010

(65) Prior Publication Data

US 2011/0277645 A1 Nov. 17, 2011

Related U.S. Application Data

(60) Provisional application No. 61/260,983, filed on Nov. 13, 2009, provisional application No. 61/385,664, filed on Sep. 23, 2010.

(51) Int. Cl.
*B65H 23/192* (2006.01)
*B65H 23/188* (2006.01)

(52) U.S. Cl.
CPC ..... *B65H 23/1882* (2013.01); *B65H 23/192* (2013.01); *B31F 2201/0779* (2013.01); *B65H 2301/51538* (2013.01); *B65H 2404/147* (2013.01); *B65H 2513/11* (2013.01); *B65H 2553/40* (2013.01); *B65H 2553/51* (2013.01); *B65H 2557/264* (2013.01); *B65H 2701/12411* (2013.01)
USPC ..... 101/23; 101/481; 101/485

(58) Field of Classification Search
CPC ..... B65H 23/1882; B65H 2557/264; B65H 2301/51538; B65H 2553/40; B31F 2201/0779
USPC ..... 101/23, 481, 484, 485, 486, 180, 248, 101/181, 183
See application file for complete search history.

(56) References Cited

U.S. PATENT DOCUMENTS 3,594,552 A * 7/1971 Adamson et al. ..... 377/18
3,611,920 A * 10/1971 Timko et al. ..... 101/35

* cited by examiner

*Primary Examiner* — Judy Nguyen
*Assistant Examiner* — Jennifer Simmons
(74) *Attorney, Agent, or Firm* — Hovey Williams LLP

(57) ABSTRACT

A rotary die apparatus and method for determining a registration error of a pattern applied to a strip of material by a rotary die. The rotary die apparatus may comprise the rotary die and a control system which senses signals from a sensor and a rotary encoder to determine an actual position of the rotary die when a fiducial on the strip of material is sensed. The control system may calculate the registration error by comparing the actual position with a registration target corresponding to a pattern length. The pattern length may correspond to the number of encoder pulses output per revolution of the rotary die divided by the number of patterns spaced apart around the circumference of the rotary die. An encoder count used to determine the actual position of the rotary die may reset each time it reaches the pattern length.

18 Claims, 4 Drawing Sheets

APPARATUS AND METHOD FOR CALCULATING REGISTRATION ERROR OF A ROTARY DIE

RELATED APPLICATIONS

This non-provisional patent application claims priority benefit with regard to all common subject matter of the earlier filed U.S. Provisional Patent Application titled "Registration Method for Rotary Converting Platform", Ser. No. 61/260,983, filed on Nov. 13, 2009, which is hereby incorporated by reference in its entirety into the present application. This non-provisional patent application also claims priority benefit with regard to all common subject matter of the earlier filed U.S. Provisional Patent Application titled "Registration Method for Rotary Converting Platform", Ser. No. 61/385,664, filed on Sep. 23, 2010, which is also hereby incorporated by reference in its entirety into the present application

BACKGROUND

1. Field

Embodiments of the present invention relate to a method and apparatus for determining registration error of patterns applied to a strip of material by a rotary die.

2. Related Art

It is known in a variety of industries to implement a manufacturing technique that involves die cutting, embossing, or stamping a series of patterns on a continuous strip of material or web of material by passing it between a pair of cooperatively rotating rotary die cylinders. This technique may be used, for example, to cut holes onto a printed strip of material at desired locations relative to indicia printed thereon. When the patterns are positioned at specific locations relative to each other or relative predetermined indicia, the patterns are said to be "in registration."

A controller or other control device may be used to achieve registration. The controller maintains a die cut at the same interval as the repeat of patterns and/or indicia on the strip of material. To line up the die and patterns printed on the strip of material, the operator offsets a registration target position, which shifts the die patterns up or down the strip of material, effectively lining up the intervals of the strip of material and the die. However, over the course of die cutting the entire length of the strip of material, the strip of material can slip out of alignment with the rotary die. If one of the patterns is not positioned precisely at the desired location on the strip of material, the amount of offset between the two may be referred to as "registration error". One type of registration error may occur in the machine direction, or in the direction of movement of the strip of material.

Manual methods for determining a registration error for each pattern applied to the strip of material are too time-consuming for mass production operations. Prior art automated methods of measuring and calculating registration error for each pattern applied by the rotary die involve complex and/or numerous equations and compare statements, which can slow the processing time and the processing capability needed to determine the registration error and correct for this registration error "on the fly" or in a substantially continual manner for each pattern.

Accordingly, there is a need for a method and apparatus for determining a registration error that overcomes the limitations of the prior art.

SUMMARY

Embodiments of the present invention provide a rotary die apparatus and method of determining a registration error or offset in a length-wise direction on a strip of material. The registration error may be an offset distance between a desired location of a pattern applied to the strip of material by the rotary die apparatus and an actual location of the pattern applied to the strip of material. The rotary die apparatus may comprise a rotary die and a motor for actuating rotation of the rotary die. The rotary die may comprise a plurality of pattern protrusions each configured for applying a pattern to the strip of material.

The rotary die apparatus may further comprise a sensor, an encoder, and a control system communicably coupled with the sensor and encoder for determining the registration error. The sensor may detect each of a plurality of fiducials or indicia located at spaced intervals on the strip of material. Each time the sensor detects one of the fiducials, it may send a signal to the control system to determine an actual position of the rotary die at that moment. The control system may compare the actual position with a registration target value to determine the registration error.

A method of calculating the registration error performed by the control system or other device may comprise maintaining a pulse count and resetting that pulse count once per pattern. Specifically, the method may comprise sensing pulses from the encoder corresponding with rotation of the rotary die and incrementing a pulse count each time a pulse from the encoder is sensed if the pulse count is less than a pattern length. The pattern length may be equal to a number of pulses per revolution of the rotary die divided by the number of pattern protrusions on the rotary die. If the pulse count is greater than or equal to the pattern length, then the control system may reset the pulse count.

Next, the method may comprise sensing a signal from the sensor indicating that one of the fiducials was sensed, and then determining an actual position of the rotary die based on the pulse count when the fiducial is detected. The method may further comprise calculating the registration error based on a difference between the actual position and a registration target corresponding with the pattern length.

A method for calculating the registration error may comprise scaling the actual position and the registration target by the pattern length. Then the method may include a step of initiating an error variable to equal a difference between the registration target and the actual position. If the absolute value of the error variable is greater than a mid-point threshold and the error variable is less than zero, then the method may proceed to a step of outputting the registration target plus the error variable as the registration error. If the absolute value of the error variable is greater than the mid-point threshold and the error variable is greater than zero, then the method may proceed to a step of outputting the error variable minus the registration target as the registration error. If the error variable is less than or equal to the mid-point threshold, then the method may proceed to a step of outputting the error variable as the registration error. The registration error may then be used to calculate a registration error correction value, which may be output to the motor or a driver of the motor.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

BRIEF DESCRIPTION OF THE DRAWING FIGURES

Embodiments of the present invention are described in detail below with reference to the attached drawing figures, wherein.

Figure 1:
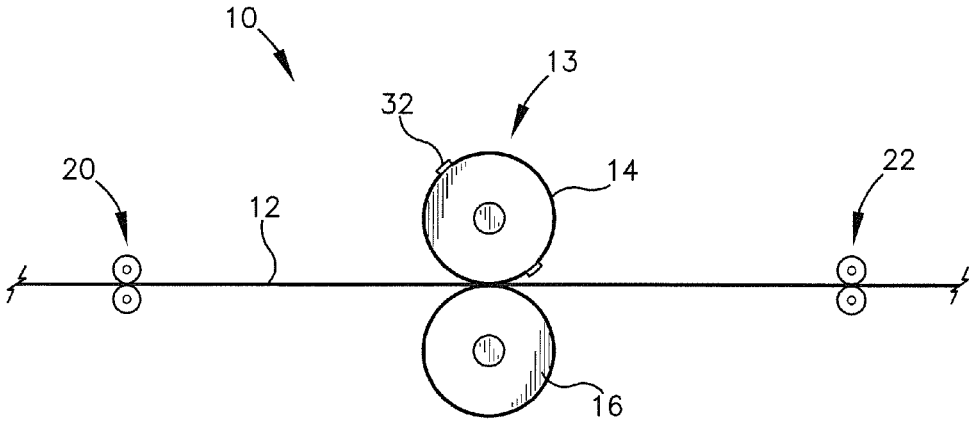
FIG. 1 is a schematic elevational view of a strip of material being fed through a rotary die apparatus constructed in accordance with an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
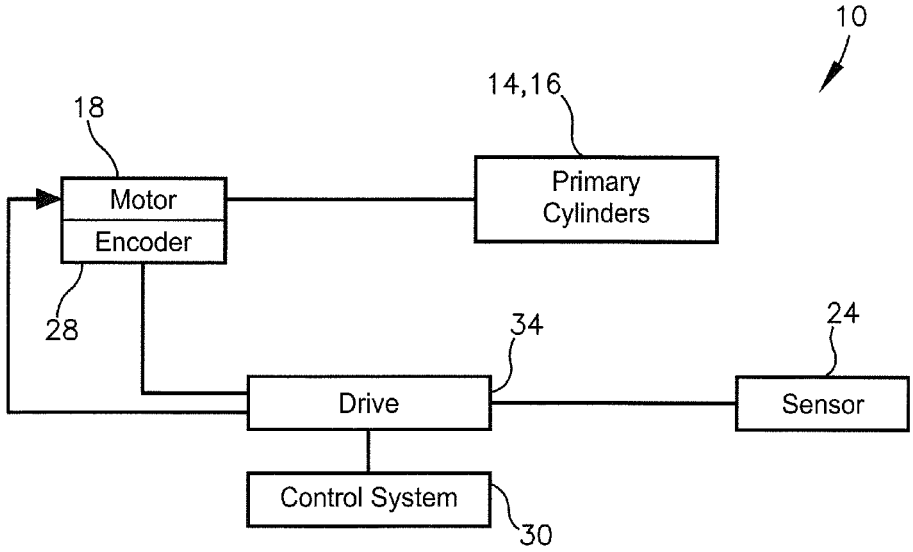
FIG. 2 is a block diagram of the rotary die apparatus of FIG. 1.

Various embodiments of the present invention include a rotary die apparatus 10 for cutting, embossing, or stamping one or more shapes or patterns into or onto a strip of material 12 at predefined intervals, as illustrated in FIGS. 1 and 2. The rotary die apparatus 10 may comprise a rotary die 13 having one or more rotary die cylinders 14,16, a motor 18 for actuating rotation of the rotary die cylinders 14,16, and a drive 34 for controlling the speed of the motor 18. In some embodiments of the invention, the rotary die apparatus 10 may also comprise feeding mechanisms 20,22 presented forward of and/or aftward of the rotary die 13 for tensioning and/or feeding the strip of material 12 in contact with the rotary die 13.

Figure 3:
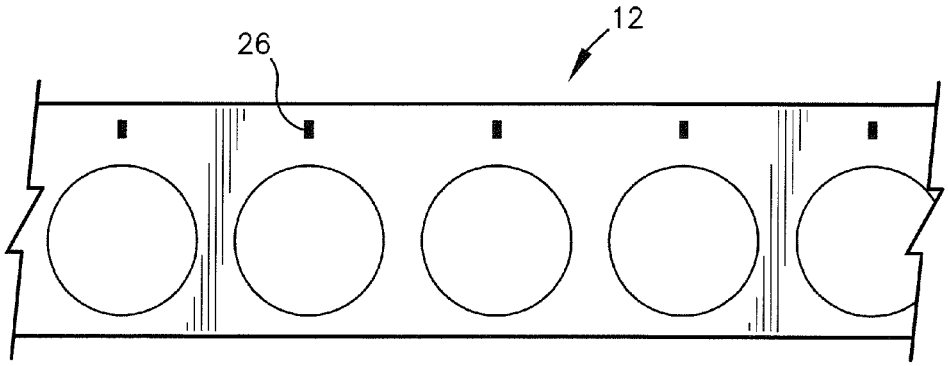
FIG. 3 is a fragmentary plan view of the strip of material of FIG. 1, illustrating a plurality of fiducials printed thereon.

As illustrated in FIG. 2, the rotary die apparatus 10 may further comprise a sensor 24 for detecting one or more indicia or fiducials 26 on the strip of material 12 (as illustrated in FIG. 3), an encoder 28 which sends a preset number of pulses per each 360-degree revolution of the motor 18, and a control system 30 configured to receive signals from the encoder 28 and/or the sensor 24. Specifically, the control system 30 may determine a registration error, which is an offset distance in a direction of travel of the strip of material between where a particular pattern should be applied to the strip of material 12 and the actual location where the pattern was applied on the strip of material 12. The registration error may be determined based on signals output by the sensor 24 and the encoder 28. The control system 30 may temporarily increase or decrease the rotary speed of the rotary die cylinders 14,16 to correct this registration error, as described below.

As illustrated in FIG. 3, the strip of material 12 may be any elongated piece of material known in the art. In some embodiments of the invention, the strip of material 12 may have a first layer with a sticky backing and a second layer onto which the first layer adheres to, such that the first layer may be pealed off of the second layer if desired. The strip of material 12 may have cuts, imprints, colors, patterns, various indicia, and/or the fiducials 26 provided thereon. A fiducial, as defined herein, may be any type of reference marking or identifying feature on the strip of material that can be used as a reference point. For example, the fiducials 26 may be printed marks located proximate an edge of the strip of material 12 at predefined intervals. Alternatively, a particular color change on the strip of material or a particular design that can be sensed at regular intervals may also be used as a fiducial.

In some embodiments of the invention, an initial die cut pattern applied to the strip of material may be used as a fiducial. Specifically, the initial die cut pattern may be cut into the strip of mater 12, then another die cut or die cuts may be aligned relative to the initial die cut patterns on the strip of material 12. The initial die cut patterns may be sensed the sensor 24. For example, if the pattern to be die cut is a ring, the inside diameter may be cut first and then the outside diameter may be registered to that cut.

The rotary die 13 may comprise one or more rotating cylinders, such as the rotary die cylinders 14,16 illustrated in FIG. 1, configured for independently or cooperatively applying one or more patterns to the strip of material 12. Specifically, two rotary die cylinders 14,16 may be positioned adjacent and substantially parallel with each other and may be configured to allow the strip of material to be fed therebetween, as illustrated in FIG. 1. At least one of the rotary die cylinders may be a male rotary die cylinder 14 with one or more pattern protrusions 32 configured for pattern cutting, embossing, or stamping. Each of the pattern protrusions 32 may comprise one or more protrusions making up a single pattern, and the single pattern defined by each of the pattern protrusions 32 may be repeated around a circumference of the male rotary die cylinder 14.

In some embodiments of the invention, the pattern protrusions 32 of the male rotary die cylinder 14 may be configured to cut or partially cut one or more shapes or patterns into the strip of material 12. Alternatively, the rotary die cylinders 14,16 may emboss the strip of material 12 with one or more shapes or patterns, stamp one or more shapes or patterns onto the strip of material with ink or die, or completely sever a portion of the strip of material 12 therefrom.

Another one of the rotary die cylinders 16 may be an anvil cylinder presenting a substantially solid outer surface and/or a female rotary die cylinder with cavities (not shown) formed therein substantially matching the shape of the male rotary die cylinder pattern protrusions 32. The male rotary die cylinder 14 may be pressed into engagement with the anvil cylinder 16 or the female rotary die cylinder to form either crush-cutting or shear-cutting nips therebetween. Alternatively, the rotary die cylinders 14,16 may have any rotary die configurations known in the art.

The motor 18 may be a rotary motor or any device known in the art for actuating rotation of at least one of the rotary die cylinders 14,16. The motor may comprise any number of gears (not shown) having pre-fabricated gear ratios and configured to transfer rotational movement of the motor 18 to at least one of the rotary die cylinders 14,16. The motor 18, its gears, and/or the rotary die cylinders 14,16 may be physically coupled with each other such that the motor 18 actuates one of the rotary die cylinders 14 to rotate in a first direction, such as counterclockwise, and actuates the other of the rotary die cylinders 16 to rotate in a second direction, such as clockwise. Additionally or alternatively, the motor 18 may rotatably drive one of the cylinders 14, which may cooperatively actuate the other of the cylinders 16 to rotate in the opposing direction.

The drive 34 may be coupled to the motor 18 and/or the control system 30 and may control the motor's speed and/or an amount of power provided to the motor 18. The drive 34 may also be configured to convert pulses output by the encoder 28 to other units. For example, a gear ratio between the motor 18 and the rotary die cylinders 14,16 may be multiplied by the number of pulses per revolution of the motor 18 to determine a number of pulses per revolution of the rotary die cylinders 14,16. This calculation may be performed by the drive 34 and/or the control system 30. Alternatively, the drive 34 and/or the control system 30 may be preset or configured to correspond with or store a known number of pulses per revolution of the rotary die cylinders 14,16.

The feeding mechanisms 20,22 may comprise one or more feed cylinders configured for providing tension and/or forward motion to the strip of material 12. For example, the feeding mechanisms 20,22 may comprise a first pair of adjacent feed cylinders 20 rotating in opposing directions and a second pair of adjacent feed cylinders 22 rotating in opposing directions. The feed cylinders 20,22 may be located forward and aftward of the rotary die cylinders 14,16, respectively, such that the strip of material 12 may be fed between the first pair of adjacent feed cylinders 20, between the rotary die cylinders 14,16, and then between the second pair of adjacent feed cylinders 22. These feed cylinders 20,22 may rotate at a constant speed approximately equal to the speed of the rotary die cylinders 14,16. However, in some embodiments of the invention, the feed cylinders 20,22 may be actuated to rotate independently of the rotary die cylinders 14,16. For example, a slight temporary change in the speed of the rotary die cylinders 14,16 to compensate for a sensed registration error, as later described herein, may be applied to correct for registration error without affecting the speed of the feed cylinders 20,22.

The sensor 24 may be any type of optical sensor, color mark sensor, or any other device operable to detect the fiducials 26 printed on the strip of material 12. The sensor 24 may send a signal to the control system 30 each time one of the fiducials 26 is sensed. In some embodiments of the invention, the location of the sensor 24 may be such that each of the fiducials 26 is sensed after it has passed between the rotary die cylinders 14,16. However, in some alternative embodiments of the invention, the location of the sensor 24 may be such that each of the fiducials 26 is sensed before it has passed between the rotary die cylinders 14,16. The sensor 24 may also be positioned at and/or sense fiducials at any distance away from the rotary die 13.

The encoder 28 may be any type of encoder or other device operable to output pulses corresponding to a particular amount of rotation or change in position, such as an incremental rotary encoder. The encoder 28 may be integral with the motor 18 or may be a stand alone unit attached to the motor 18 and/or the rotary die cylinders 14,18. The encoder 28 may be configured to output a predetermined number of pulses per revolution of the motor 18 or at least one of the rotary die cylinders 14,16. These pulses may be electrical signals or any other signal or periodic response for which a count may be maintained. For example, the encoder 28 may output 6,000,000 pulses per revolution of at least one of the rotary die cylinders 14,16.

The control system 30 may comprise any number or combination of controllers, circuits, integrated circuits, programmable logic devices such as programmable logic controllers (PLC) or motion programmable logic controllers (MPLC), computers, processors, microcontrollers, or other control devices and residential or external memory for storing data and other information accessed and/or generated by the rotary die apparatus 10. The control system 30 may be coupled with the encoder 28, the sensor 24, the motor 18, the drive 34, and/or other switches, sensors, and components through wired or wireless connections, such as a data bus (not shown), to enable information to be exchanged between the various components. The control system 30 may be configured to receive signals from the encoder 28 and sensor 24, calculate a registration error, and command the motor 18 and/or the drive 34 to take corrective action based on the calculated registration error for each pattern. The control system 30 may be configured to implement any combination of the algorithms, subroutines, or code described herein to calculate the registration error for each pattern or sensed fiducial.

The control system 30 and computer programs described herein are merely examples of computer equipment and programs that may be used to implement the present invention and may be replaced with or supplemented with other controllers and computer programs without departing from the scope of the present invention. The features of the control system 30 may be implemented in a stand-alone device, which is then interfaced to a rotary die apparatus or system. The control features of the present invention may also be distributed among the components of the rotary die apparatus 10. Thus, while certain features are described as residing in the control system 30, the invention is not so limited, and those features may be implemented elsewhere.

The control system 30 may implement a computer program and/or code segments to perform some of the functions and method described herein. The computer program may comprise an ordered listing of executable instructions for implementing logical functions in the control system 30. The computer program can be embodied in any computer-readable medium for use by or in connection with an instruction execution system, apparatus, or device, and execute the instructions. In the context of this application, a "computer-readable medium" can be any means that can contain, store, communicate, propagate, or transport the program for use by or in connection with the instruction execution system, apparatus, or device. The computer-readable medium can be, for example, but not limited to, an electronic, magnetic, optical, electro-magnetic, infrared, or semi-conductor system, apparatus, or device. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

The control system 30 may be configured to calculate an amount of error for each pattern, as later described herein. In some embodiments of the invention, the drive 34 and the control system 30 may be integrally combined into a single control system device or processor. In other embodiments of the invention, multiple rotary die apparatuses 10 may each have their own drive 34. Each of the plurality of drives 34 may communicate with a single control device 30 configured for calculating the registration errors for each of the multiple rotary die apparatuses 10.

The control system 30 and/or the drive 34 may be configured to scale the position feedback of the rotary die cylinders 14,16 provided by the encoder 28 into other units. For example, the pulses provided by the rotary encoder 28 may be converted to pulses per motor revolution, pulses per rotary die cylinder revolution, pulses per degree of rotation, or pulses per pattern. Specifically, if there are 6,000,000 pulses per 360-degree revolution, then there may be 16,666.6 pulses per degree of revolution. Using these values, the control system 30 or drive 34 may maintain a count of degrees of rotation instead of a pulse count.

In some embodiments of the invention, the control system 30 or the drive 34 may be configured to maintain a pulse count of the encoder's pulses and to restart counting after 360-degrees or a complete rotation. This may be accomplished by setting a position unwind value. For example, the position unwind value may be 6,000,000 counts in the example where there are 6,000,000 pulses per revolution. So, instead of counting the next pulse as 6,000,001, the next pulse is considered to be pulse number one, followed by pulse number two, etc. However, the position unwind value may be set to any value. For example, if the position unwind value is set at 3,000,000 and there are 6,000,000 pulses per revolution, then the control system or drive would restart counting every 180-degrees or twice per revolution. In some embodiments of the invention, the pulse count may refer to any count directly corresponding to the rotational position of the rotary die 13, and may be tracked or maintained in any units, such as in degrees, inches, centimeters, etc. Furthermore, resetting the pulse count may involve reinitializing the pulse count to its starting value.

Figure 4:
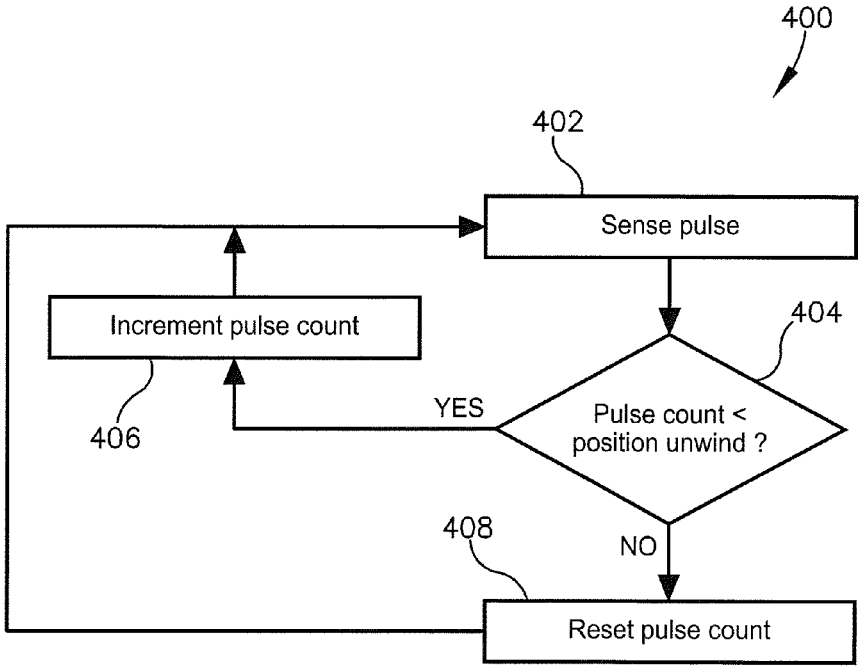
FIG. 4 is a flow chart of a method for maintaining a count of pulses output by a rotary encoder of the rotary die apparatus.

The flow chart of FIG. 4 depicts the steps of an exemplary method 400 for maintaining a pulse count in more detail. Some of the steps of the method may be implemented with the control system 30, its computer programs, and/or other components of the rotary die apparatus 10, such as the drive 34. In some alternative implementations, the functions noted in the various blocks may occur out of the order depicted in FIG. 4. For example, two blocks shown in succession in FIG. 4 may in fact be executed substantially concurrently, or the blocks may sometimes be executed in the reverse order depending upon the functionality involved.

Specifically, the method 400, as depicted in FIG. 4, may include a step of sensing pulses from the encoder 28, as depicted in box 402. The pulses may be sensed by the drive 34 and/or the control system 30. The method 400 may further include a step of determining if the pulse count is less than the position unwind value, as depicted in box 404. If it is, the method 400 proceeds to a step of incrementing the pulse count, as depicted in box 406. The position unwind value may correspond with the number of pulses per revolution and/or 360-degrees. Alternatively, the position unwind value may be set to any value and, as later described herein, may be set to correspond with a pattern length value. If the pulse count is not less than the position unwind value, the method 400 may proceed to a step of resetting the pulse count, as depicted in box 408. For example, the pulse count may be reset to zero or 1.

In operation, the strip of material 12 with the plurality of spaced apart fiducials 26 is fed between the rotary die cylinders 14,16. When the sensor 24 detects one of the fiducials 26, the current or actual position of the rotary die cylinders 14,16, based on the current pulse count, is compared with a desired position or registration target of the rotary die cylinders 14,16 to determine the registration error. The rotary die cylinders 14,16 can then be adjusted by a desired amount to correct this calculated registration error.

Figure 5:
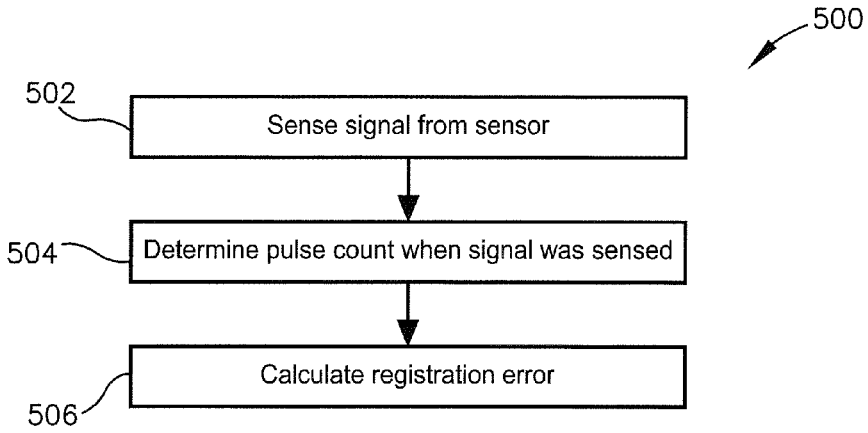
FIG. 5 is a flow chart of a method for determining a registration error in accordance with an embodiment of the present invention.

The flow chart of FIG. 5 depicts the steps of an exemplary method 500 for determining the registration error in more detail. Some of the steps of the method may be implemented with the control system 30, its computer programs, and/or other components of the rotary die apparatus 10, such as the drive 34. In some alternative implementations, the functions noted in the various blocks may occur out of the order depicted in FIG. 5. For example, two blocks shown in succession in FIG. 5 may in fact be executed substantially concurrently, or the blocks may sometimes be executed in the reverse order depending upon the functionality involved.

Specifically, the method 500, as illustrated in FIG. 5, may include the steps of sensing a signal from the sensor 24 that one of the fiducials 26 was sensed, as depicted in box 502, then determining the actual position of the rotary die 13 based on the pulse count when the fiducial is detected, as depicted in box 504. The method 500 may also include calculating the registration error based on a difference between the actual position and the registration target, as depicted in box 506. The registration target may correspond with the pattern length, as described below.

Note that the registration target and/or the actual position provided to the control system 30 may need to be scaled and/or offset for various reasons. For example, because the sensor 24 may be located at any distance relative to the rotary die cylinders 14,16, the actual position when the fiducial is sensed may not necessarily correspond with one of the registration targets, even if the pattern protrusions 32 are being applied at the desired locations on the strip of material 12. The drive 34, the control system 30, and/or an operator may add or subtract a sensor offset distance to compensate for this discrepancy. Alternatively, the control system 30 may add or subtract the sensor offset distance to or from each of the actual positions provided to the control system 30 when a fiducial is sensed.

One method for the control system 30 to determine the registration error in degrees requires a determination of an appropriate value for the registration target. The control system may first determine the pattern length by dividing 360-degrees by the number of patterns or pattern protrusions 32. The pattern length may represent the distance between a starting point of one pattern protrusion 32 and a starting point of its adjacent pattern protrusion 32 on the male rotary die cylinder 14. Then the actual position (converted to degrees) may be compared with a multiple of the pattern length to determine a registration error. For example, if there are 4 equally-spaced pattern protrusions 32 placed around the male rotary die cylinder 14, then the pattern length may be assigned a value of 90-degrees. One of the registration targets may be reached once every 90-degrees of rotation at 90-degrees, at 180-degrees, at 270-degrees, and at 360-degrees.

Figure 6:
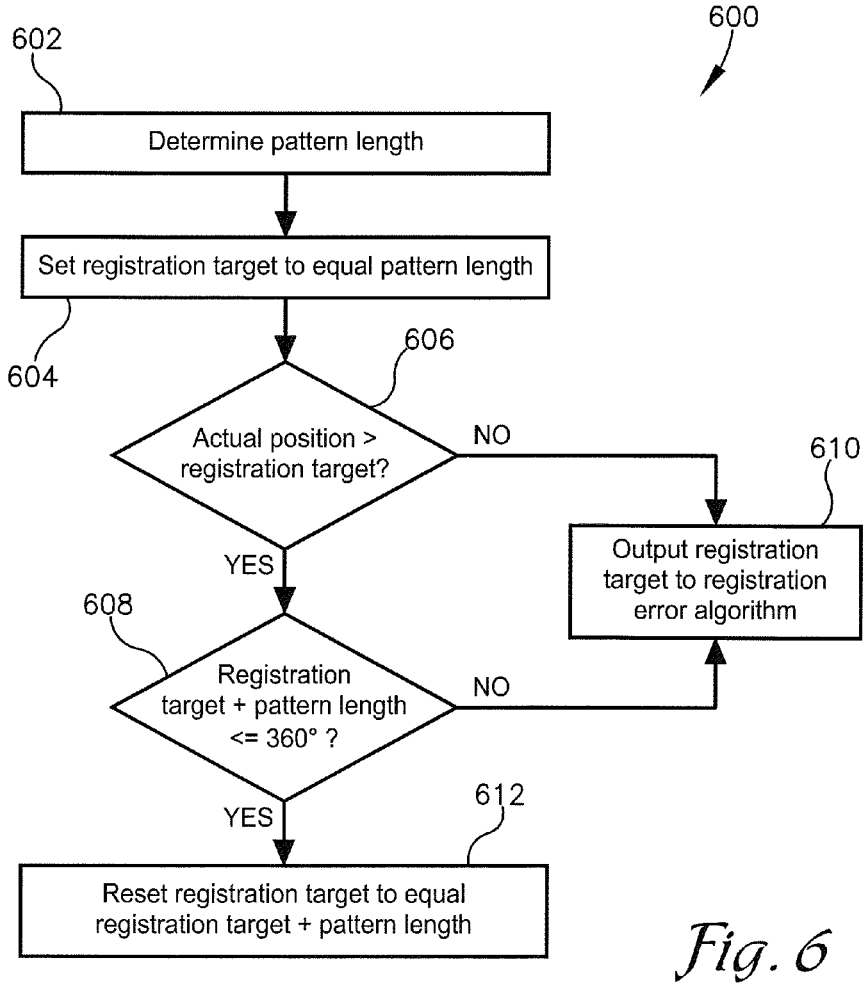
FIG. 6 is a flow chart of a method for choosing a registration target in accordance with an embodiment of the present invention.

The flow chart of FIG. 6 depicts the steps of an exemplary method 600 for determining an appropriate target registration value in more detail. Some of the steps of the method may be implemented with the control system 30, its computer programs, and/or other components of the rotary die apparatus 10, such as the drive 34. In some alternative implementations, the functions noted in the various blocks may occur out of the order depicted in FIG. 6. For example, two blocks shown in succession in FIG. 6 may in fact be executed substantially concurrently, or the blocks may sometimes be executed in the reverse order depending upon the functionality involved.

As illustrated in FIG. 6, to determine the value of the registration target for comparison with the actual position, a registration target algorithm or subroutine may be repeated by the control system until the "if" statements therein are no longer true. A pseudo-code representation of the registration target algorithm may comprise the following IF-THEN statement:

```
IF (actual position > registration target)
AND
(registration target + pattern length) ≤ 360-degrees
THEN
registration target = registration target + pattern length
```

Specifically, the method 600, illustrated in FIG. 6, may include the step of calculating the pattern length, as depicted in box 602. For example, the pattern length may be calculated by dividing the number of patterns or pattern protrusions 32 of the rotary die cylinder 14 into 360 degrees or the total number of pulse counts per revolution. The method may further include a step of setting the registration target to equal the pattern length, as depicted in box 604. As depicted in box 606, the method may then include determining if the actual position is greater than the registration target, and, as depicted in box 608, if the registration target plus the pattern length (in degrees) is less than or equal to 360-degrees. If the answers to the steps depicted in boxes 606 and 608 are both yes, then the method may proceed to a step of updating the registration target by adding the pattern length to the current value of the registration target, as depicted in box 610. The updated registration target may be plugged back into the target registration algorithm. Otherwise, as depicted in box 612, if the actual position is NOT greater than the registration target and/or the registration target plus the pattern length (in degrees) is NOT less than 360-degrees, then the method may proceed to a step of outputting the registration target.

In some embodiments of the invention, the registration target algorithm may be used to determine the target registration each time one of the fiducials is sensed, prior to any registration error calculations. Then calculation of the registration error may involve determining a difference between the actual position and the registration target. An adjustment of the strip of material 12 forwards or backwards or an increase or decrease of motor speed may depend on whether the registration error calculated is positive or negative. However, the position unwind value can complicate these calculations. Specifically, the registration error can not be calculated the same for the first and last pattern of the rotary die cylinder 14 as the registration error of those patterns in the middle. For example, if 360-degrees is the registration target, and the actual position is 4-degrees, the registration target minus the actual position would result in 356 degrees instead of a more desirable 4-degrees registration error.

One embodiment of the registration error algorithm used to correct this problem requires the control system to determine if the following equation is true:

$$\text{Registration error} > \text{pattern length} \times (\text{number of patterns} - 1)$$

If the above equation is true, then 360-degrees may be subtracted from the calculated registration error. Otherwise, the registration error is output without modification. The above method of determining registration error may not work in all situations, such as if the sensor misses a fiducial. Some additional equations and compare statements may be applied to be sure that a fiducial was not missed. However, each additional comparison statement or equation included in the registration error algorithm must be solved for each pattern or pattern protrusion, which can increase the overall computing time and slow the overall process of cutting the desired number of patterns into the strip of material 12. Therefore, other improved methods for determining the registration error are provided below.

Figure 7:
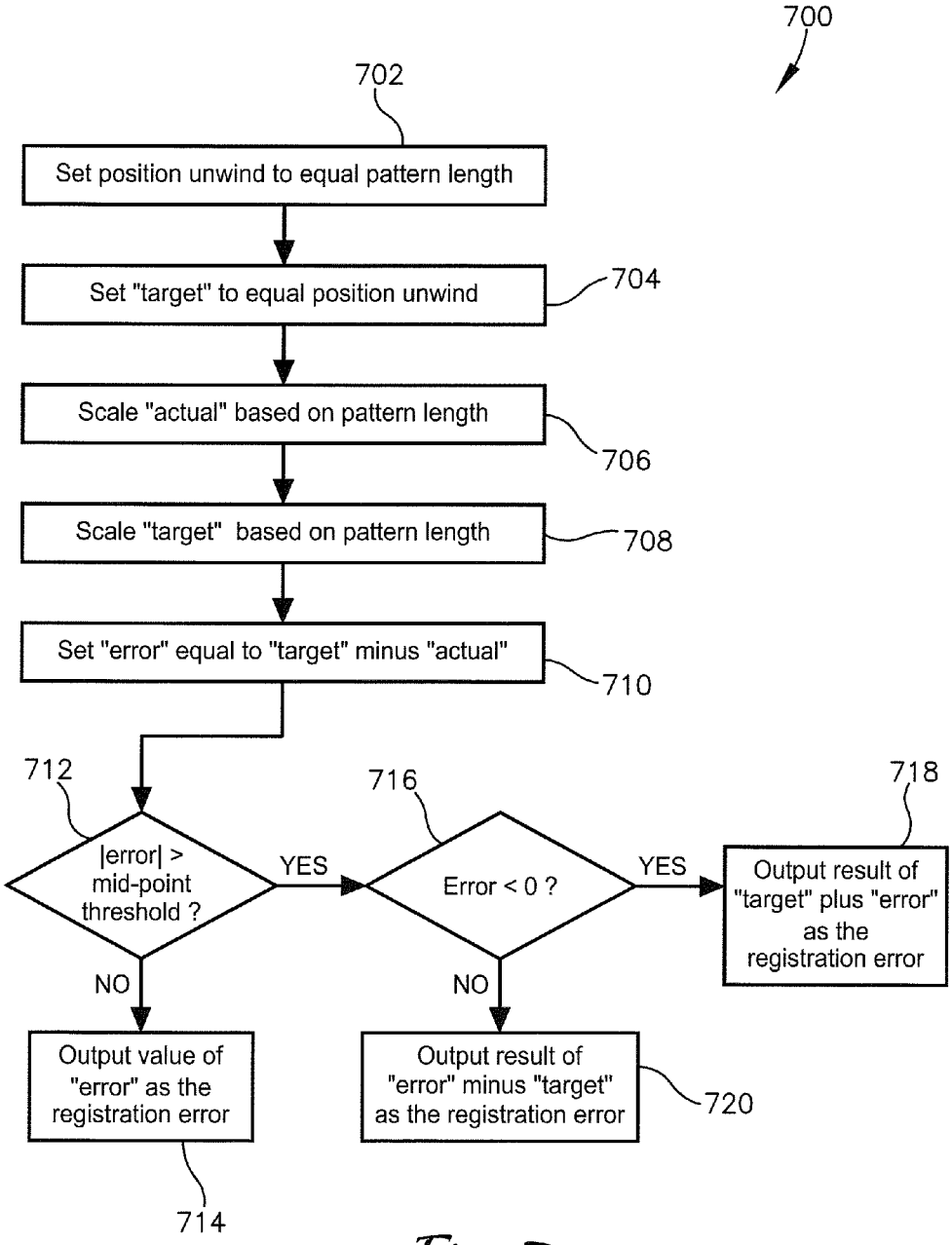
FIG. 7 is a flow chart of a method for determining a registration error in accordance with an embodiment of the present invention.

The flow chart of FIG. 7 depicts the steps of an exemplary method 700 for determining the registration error in more detail. Some of the steps of the method may be implemented with the control system 30, its computer programs, and/or other components of the rotary die apparatus 10, such as the drive 34. In some alternative implementations, the functions noted in the various blocks may occur out of the order depicted in FIG. 7. For example, two blocks shown in succession in FIG. 7 may in fact be executed substantially concurrently, or the blocks may sometimes be executed in the reverse order depending upon the functionality involved.

As illustrated in FIG. 7, the method 700 of calculating registration error does not require the registration target algorithm described above and depicted in FIG. 6 to determine the registration target and does not require converting the encoder pulses to degrees. Instead, the position unwind value is calculated to correspond with the pattern length. Specifically, the position unwind value may correspond with the number of pulses per pattern or the degrees per pattern. The pattern length can be determined by dividing the number of pulses per revolution (or the number of degrees per revolution) by the number of patterns or pattern protrusions 32 on the male rotary die cylinder 14. For example, if there are four patterns per revolution and 6,000,000 pulses per revolution, the position unwind value may be 1,500,000. Because the pulse count returns to zero at the beginning of each pattern, the registration target is always the same, making the algorithm for determining the registration target, as illustrated in FIG. 6, unnecessary.

In some embodiments of the invention, the actual position and/or the pulse count may be converted to values ranging from 0 to 1. This conversion may be performed by the control system 30 or the drive 34. Specifically, the registration target may be divided by the pattern length or position unwind, thereby setting the registration target to equal 1. Likewise, the actual position may be divided by the pattern length or position unwind. For example, if there are 1,500,000 pulses per pattern, then the actual position in pulses may be divided by 1,500,000 to scale the actual position prior to solving registration error equations, such as those described below. This scaling allows a simple conversion to any desired units, since the registration error will be provided as a fraction or percentage of the total pattern length. However, the registration target and the actual position may be scaled by any desired value.

The control system 30 and/or calculating device 36 may be configured and/or programmed to determine the registration error using a registration error algorithm or subroutine according to method 700 as illustrated in FIG. 7. First, as depicted in box 702, the method may include setting the position unwind to equal the pattern length. For example, determining the position unwind may include dividing the number of patterns or pattern protrusions 32 into the total number of encoder pulses per revolution of the rotary die cylinders 14,16. As referenced herein, a variable "target" refers to the registration target, and a variable "actual" refers to the actual position of the rotary die cylinders 14,16 when one of the fiducials 26 is sensed. As noted above, "actual" and/or "target" may be scaled to any units and/or offset by a sensor offset value in some embodiments of the invention. The method 700 may further include setting or initializing the variable "target" to equal the pattern length or position unwind value, as depicted in box 704. Boxes 706 and 708 depict scaling "actual" and "target" based on the pattern length. For example, "actual" and "target" may be divided by the original value of "target", the position unwind value, or the pattern length.

As depicted in box 710, the method may then include setting a variable "error" to equal a difference between "target" and "actual". Then the control system 30 may determine if the absolute value of "error" is greater than a mid-point threshold value, as depicted in box 712. The mid-point threshold may be a value mid-way between zero and the registration target (i.e. "target"). For example, if the variable "target" is scaled to equal 1, then the mid-point threshold value may be 0.5.

If "error" is not greater than the mid-point threshold value, then the method may proceed to a step of outputting the value of "error" as the registration error, as depicted in box 714. If the absolute value of "error" is greater than the mid-point threshold value, then the method 700 may proceed to determining if the variable "error" is less than zero, as depicted in box 716. If it is, then the method 700 may proceed to a step of outputting the result of "target" plus "error" as the registration error, as depicted in box 718. If "error" is not less than zero, then the method 700 may proceed to a step of outputting "error" minus "target" as the registration error, as depicted in box 720.

The registration error algorithm illustrated in FIG. 7 may be represented by the following pseudo code if "target" and "actual" are scaled by the pattern length so that "target" equals 1 and "actual" equals a value from 0 to 1:

```
error = target − actual
IF (|error| > 0.5 AND error < 0) THEN
    registration error = 1 + error
IF (|error| > 0.5 AND error >0) THEN
    registration error = −1 + error
IF (error <= 0.5) THEN
    registration error = error
```

Furthermore, the registration error algorithm above may be represented in other alternative and equivalent forms without departing from the scope of the invention, such as provided in the following pseudo code:

```
error = target − actual
IF (|error| < 0.5 AND error < actual) THEN
    registration error = target − actual
IF (NOT(|error| < 0.5) AND error < actual) THEN
    registration error = 1 + (target − actual)
IF (|error| < 0.5 AND NOT(error < actual)) THEN
    registration error = −1(target − actual)
IF (NOT(|error| < 0.5) AND NOT (error < actual)) THEN
    registration error = −1 + (target−actual)
```

A variety of methods of adjusting the rotary die apparatus 10 may be employed using the registration error calculated by the control system 30. For example, the rotary die cylinders 14,16 may be actuated to speed up by a desired amount for a given length of time in order to correct for the amount of registration error over the course of the subsequent one or more patterns. To prevent pulling or tearing of the strip of material 12 during this adjustment, correction speed thresholds or limits may be programmed into the control system 30.

Specifically, in some embodiments of the invention, the registration error may be input as a variable into a registration error correction algorithm. The registration error correction algorithm may then be calculated using the registration error and may output a solution to the motor 18 or the drive 34. The solution of the registration error correction algorithm may correspond with an amount by which to decrease or increase a rotary speed of the motor 18 in order to decrease the registration error of subsequent patterns applied by the rotary die 13.

The control system 30 may return a frequency value in patterns per second instead of revolutions per second, since the pattern unwind occurs once per pattern instead of once per revolution. The period, which is one divided by the frequency value, is the time given to each pattern. This can be used for registration windowing as well as calculating an acceleration and velocity of the corrections to be made for each pattern.

Although the invention has been described with reference to the preferred embodiment illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A method of determining a registration error in a lengthwise direction on a strip of material between a desired location of a pattern applied to the strip of material by a rotary die and an actual location of the pattern applied by the rotary die, the method comprising the steps of:

sensing pulses from an encoder corresponding with rotation of the rotary die;

incrementing a pulse count each time a pulse from the encoder is sensed if the pulse count is less than a pattern length, wherein the pattern length corresponds to a number of pulses per revolution of the rotary die divided by a quantity of patterns applied to the strip of material per revolution of the rotary die;

resetting the pulse count if the pulse count is greater than or equal to the pattern length;

sensing a signal from a sensor configured to detect when a fiducial is sensed on the strip of material;

determining an actual rotational position of the rotary die based on the pulse count when the fiducial is detected;

setting an actual variable to correspond with the actual rotational position; and calculating the registration error based on a difference between the actual variable and a registration target, wherein the pattern is one of a plurality of patterns spaced in even increments around the rotary die such that the quantity of patterns applied to the strip of material per revolution of the rotary die is greater than 1 and the pulse count is reset for each one of the plurality of patterns of the rotary die;

wherein the registration target is a value corresponding to a desired rotational position of the pattern, and wherein the registration target is a constant value regardless of which pattern of the plurality of patterns occupies the desired rotational position.

2. The method of claim 1, wherein the step of calculating the registration error comprises:

setting an error variable to correspond with the registration target minus the actual variable.

3. The method of claim 2, further comprising outputting the pattern length plus the error variable as the registration error if the absolute value of the error variable is greater than a mid-point threshold and the error variable is less than zero, wherein the mid-point threshold is a value mid-way between zero and the pattern length.

4. The method of claim 2, further comprising outputting the error variable minus the pattern length as the registration error if the absolute value of the error variable is greater than a mid-point threshold and the error variable is greater than zero, wherein the mid-point threshold is a value mid-way between zero and the pattern length.

5. The method of claim 2, further comprising outputting the error variable as the registration error if the error variable is less than or equal to the mid-point threshold, outputting the pattern length plus the error variable as the registration error if the absolute value of the error variable is greater than the mid-point threshold and the error variable is less than zero, and outputting the error variable minus the pattern length as the registration error if the absolute value of the error variable is greater than the mid-point threshold and the error variable is greater than zero, wherein the mid-point threshold is a value mid-way between zero and the pattern length.

6. The method of claim 1, further comprising the steps of:

inputting the registration error as a variable into a registration error correction algorithm;

solving the registration error correction algorithm using the registration error; and outputting the solution of the registration error correction algorithm to a motor or a drive of the motor for actuating rotation of the rotary die.

7. The method of claim 6, wherein the solution of the registration error correction algorithm corresponds with an amount of decrease or increase in a rotary speed of a motor actuating the rotary die which will decrease the registration error of subsequent patterns applied by the rotary die.

8. The method of claim 1, further comprising converting the pulse counts into units of degrees.

9. The method of claim 1, wherein the sensor is a color mark sensor configured to output a signal each time it senses a pre-defined fiducial on the strip of material.

10. The method of claim 1, wherein the encoder is a rotary encoder of the motor.

11. A rotary die apparatus comprising:

a rotary die having a quantity of pattern protrusions extending outward therefrom and configured to cut, emboss, or stamp a pattern onto a strip of material, the quantity being greater than 1;

a motor coupled to the rotary die and configured to rotate the rotary die;

an encoder coupled to at least one of the rotary die and the motor and configured to output a particular number of pulses per revolution of the rotary die;

a sensor configured to sense one or more pre-defined fiducials on the strip of material and to output a signal each time the sensor senses one of the fiducials; and a control system configured to receive signals from the encoder and the sensor, increment a pulse count each time a signal from the encoder is sensed if the pulse count is less than a pattern length, reset the pulse count if the pulse count is greater than or equal to the pattern length, determine an actual rotational position of the rotary die based on the pulse count when the fiducial is detected, set an actual variable to correspond with the actual rotational position, and calculate a registration error based on a difference between the actual variable and a registration target, and the pattern length is equal to the number of signals sensed from the encoder per revolution of the rotary die divided by the quantity of pattern protrusions, wherein the pulse count is reset for each one of the plurality of patterns of the rotary die;

wherein the registration target is a value corresponding to a desired rotational position of one pattern protrusion of the quantity of pattern protrusions on the rotary die; and wherein the registration target is a constant value regardless of which pattern protrusion of the quantity of pattern protrusions occupies the desired rotational position.

12. The rotary die apparatus of claim 11, wherein the control system is further configured to:

scale the registration target and the actual rotational position by a value corresponding to the pattern length;

initialize an error variable to equal the registration target minus the actual rotational position;

output the pattern length plus the error variable as the registration error if the absolute value of the error variable is greater than a mid-point threshold and the error variable is less than zero;

output the error variable minus the pattern length as the registration error if the absolute value of the error variable is greater than the mid-point threshold and the error variable is greater than zero; and output the error variable as the registration error if the error variable is less than or equal to the mid-point threshold.

13. The rotary die apparatus of claim 12, wherein the mid-point threshold is mid-way between zero and the pattern length.

14. The rotary die apparatus of claim 11, wherein the control system is configured to calculated a decrease or an increase in a rotary speed of the motor over a given distance or amount of time by an amount corresponding to the registration error to decrease the registration error of subsequent patterns.

15. The rotary die apparatus of claim 11, further comprising a drive communicably coupled with the control system and the motor, configured to convert or scale the pulse counts into other units, and configured to control a rotary speed of the motor.

16. The rotary die apparatus of claim 11, wherein the encoder is a rotary encoder of the motor.

17. A computer-readable medium encoded with a nontransitory computer program for determining a registration error in a length-wise direction on a strip of material between a desired location of a pattern applied to the strip of material by a rotary die and an actual location of the pattern applied by the rotary die, the computer program configured to perform the following steps:

sensing pulses from an encoder corresponding with rotation of the rotary die;

incrementing a pulse count each time a pulse from an encoder is sensed by the control system if the pulse count is less than a pattern length, wherein the pattern length corresponds to a number of pulses per revolution of the rotary die divided by the number of pattern protrusions on the rotary die;

resetting the pulse count if the pulse count is greater than or equal to the pattern length;

sensing a signal from a sensor configured to detect when a fiducial is sensed on the strip of material;

determining an actual rotational position of the rotary die based on the pulse count when the fiducial is detected; and calculating the registration error based on a difference between the actual rotational position and a registration target, wherein the pattern is one of a plurality of patterns spaced in even increments around the rotary die such that the quantity of patterns applied to the strip of material per revolution of the rotary die is greater than 1 and the pulse count is reset for each one of the plurality of patterns of the rotary die; and wherein the registration target is a value corresponding to a desired rotational position of the pattern; and wherein the registration target is a constant value regardless of which pattern of the plurality of patterns occupies the desired rotational position.

18. The computer-readable medium of claim 17, wherein the computer program is further configured to perform the following steps:

scaling the actual rotational position by a value corresponding to the pattern length;

initializing an error variable to equal the registration target minus the actual rotational position;

outputting the pattern length plus the error variable as the registration error if the absolute value of the error variable is greater than a mid-point threshold and the error variable is less than zero, wherein the mid-point threshold is midway between zero and the pattern length;

outputting the error variable minus the pattern length as the registration error if the absolute value of the error variable is greater than the mid-point threshold and the error variable is greater than zero; and outputting the error variable as the registration error if the error variable is less than or equal to the mid-point threshold.

* * * * *